United States Patent [19]

Nishishita et al.

[11] Patent Number: 5,036,914

[45] Date of Patent: Aug. 6, 1991

[54] VEHICLE-LOADED PARALLEL FLOW TYPE HEAT EXCHANGER

[75] Inventors: Kunihiko Nishishita; Takashi Sugita, both of Saitama, Japan

[73] Assignee: Diesel Kiki Co., Ltd., Tokyo, Japan

[21] Appl. No.: 481,933

[22] Filed: Feb. 16, 1990

[51] Int. Cl.[5] ..... F28F 9/02

[52] U.S. Cl. ..... 165/173; 165/153

[58] Field of Search ..... 165/152, 153, 173; 228/183; 29/890.052

[56] References Cited

U.S. PATENT DOCUMENTS

| | | | |
|---|---|---|---|
| 1,795,055 | 5/1931 | Taylor et al. | 165/153 X |
| 3,866,675 | 2/1975 | Bardon et al. | 165/173 |
| 4,159,034 | 6/1979 | Bellovary et al. | 165/153 |
| 4,509,672 | 4/1985 | Woodhull, Jr. et al. | 228/175 |
| 4,759,405 | 7/1988 | Metzger | 165/173 |

FOREIGN PATENT DOCUMENTS

| | | | |
|---|---|---|---|
| WO84-1208 | 3/1984 | PCT Int'l Appl. | 165/153 |
| 944094 | 12/1963 | United Kingdom | 29/890.052 |
| 2082312A | 3/1982 | United Kingdom | 165/173 |

*Primary Examiner*—Allen J. Flanigan

*Attorney, Agent, or Firm*—Kanesaka & Takeuchi

[57] ABSTRACT

Here is disclosed a vehicle-loaded heat exchanger comprising a plurality of tubes extending in parallel with one another, an inlet header pipe and an outlet header pipe respectively connected to opposite ends of said tubes, wherein each of the header pipes is longitudinally divided into two components, namely, a tank and an end plate both presenting outwardly swelling walls and the end plate is integrally joined to the tank with opposite joint side edges of the former bearing against the inner surfaces of corresponding opposite joint side edges of the latter. With such heat exchanger, parallel flows of coolant passing through a plurality of tubes are established between the inlet and outlet header pipes and thereby desired heat exchange is obtained. To install the header pipes, the end plate, one component of each header pipe, is formed by pressing with openings for insertion of the tubes and then the end plate is joined as by brazing to the tank with the joint side edges of the end plate being placed inside the joint side edges of the tank.

2 Claims, 4 Drawing Sheets

VEHICLE-LOADED PARALLEL FLOW TYPE HEAT EXCHANGER

BACKGROUND OF THE INVENTION

1. Field of the Invention

The present invention relates to a high-pressure heat exchanger including a plurality of tubes extending in parallel with one another, an inlet header pipe connected to one ends of the respective tubes and an outlet header pipe connected to the other ends of the respective tubes so that parallel flows of coolant are established between the both header pipes.

2. Prior Art

The well known parallel flow type heat exchanger of (such as a high-pressure condenser for a car air conditioner) usually comprises a plurality of flat tubes extending in parallel with one another, an inlet header pipe connected to one ends of the respective tubes and an outlet header pipe connected to the other ends of the respective tubes.

In such a heat exchanger of the prior art, connection of the each header pipe with the respective tubes has typically been achieved by (1) inserting each tube 23 into the corresponding one of insertion openings 22 formed through a wall of the header pipe 21 having circular cross-section, as illustrated by FIG. 7 (e.g., Japanese Patent Application Disclosure Gazette No. 1988-34466) or by (2) inserting each tube 28 into the corresponding one of insertion openings 27 formed through an end plate 26 which is, in turn, diametrically assembled with a tank 25 to form a header pipe 24, as illustrated by FIG. 8 (e.g., Japanese Patent Application Disclosure Gazette No. 1988-105400).

With such heat exchangers of the prior art, the desired heat exchange is achieved by parallel flows of coolant passing through said plurality of flat tubes extending between the inlet header pipe and the outlet header pipe.

However, in the arrangement set forth above in (1), it has been difficult to form the insertion openings for the flat tubes through the curved wall of the header pipe having a circular cross-section, and accordingly this has resulted in time-consuming work and increased cost for manufacturing.

In the arrangement set forth above in (2), on the other hand, formation of the insertion openings through the end plate has certainly been facilitated by the two-component structure of the header pipe, but this arrangement has still been inconvenient because the pressure resistance of the end plate to the coolant flowing through the header pipe along a junction between the end plate and the tank is lowered, and because the end plate is substantially planar and is tightly joined to the tank on the outer surface thereof.

The present invention has been made to provide, in view of the above-mentioned problems encountered by the heat exchanger of the prior art, an effective solution to such problems.

SUMMARY OF THE INVENTION

Accordingly, a principal object of the invention is to provide a high-pressure heat exchanger so improved to facilitate the formation of flat tube insertion openings through the wall of a header pipe and to enhance the pressure resistance of the header pipe.

The object as set forth above is achieved, according to this invention, by a high-pressure heat exchanger including a plurality of tubes extending in parallel with one another, an inlet header pipe connected to one ends of the respective tubes and an outlet header pipe connected to the other ends of the respective tubes, so that parallel flows of coolant are established between the both header pipes, characterized by that each of said header pipes is longitudinally divided into two components, i.e., a tank and an end plate each having a outwardly extending wall and that the end plate is integrally joined to the tank with the outer surfaces of opposite side edges of the former bearing against the inner surfaces of the corresponding opposite side edges of the latter.

These and other features, objects and advantages of the invention will be more apparent from the following detailed description of preferred embodiments given in reference with the accompanying drawings.

DETAILED DESCRIPTION OF PREFERRED EMBODIMENTS

Figure 1:
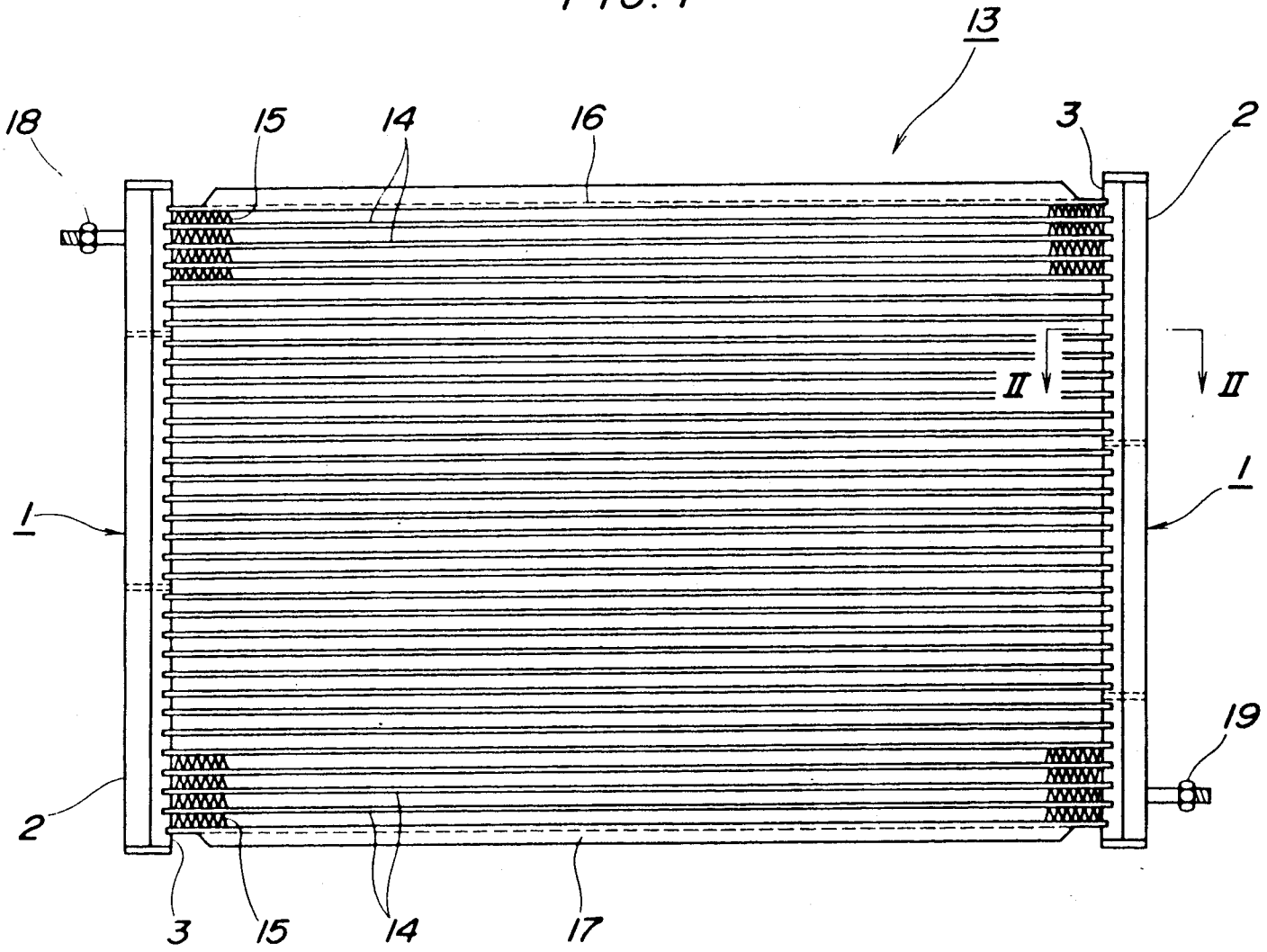
FIGS. 1 and 2 illustrate a first embodiment of the invention, FIG. 1 being a front view of the heat exchanger and FIG. 2 being a cross-sectional view of a header pipe taken along a line II—II in FIG. 1.
Figure 2:
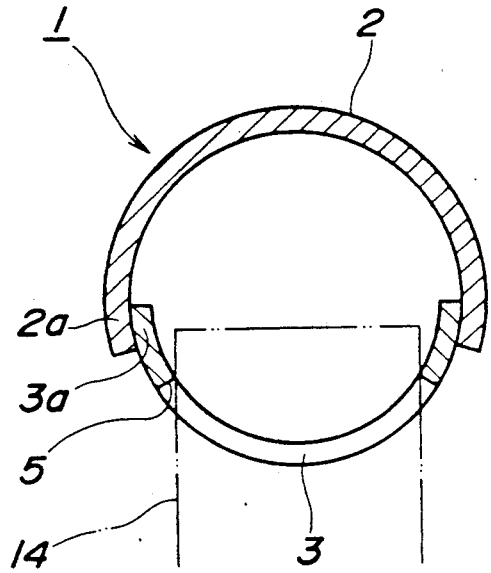

FIGS. 1 and 2 illustrate the first embodiment of the invention.

A heat exchanger 13 (such as a high-pressure condenser) constructed according to the invention comprises, as seen in FIG. 1, a plurality of flat tubes 14 extending in parallel with one another between an inlet header pipe 1 and an outlet header pipe 1. Corrugated fins 15 interspace said plurality of flat tubes 14. Each of the flat tubes 14 is, at its opposite ends, inserted into tube insertion openings formed through walls of the inlet and outlet header pipes 1, 1, respectively, and tightly joined thereto. Thus, the parallel flow type heat exchanger of the invention is constructed so that parallel flows passing through a plurality of flat tubes 14 are established between the inlet header pipe 1 and the outlet header pipe 1. Referring to FIG. 1, reference numerals 16, 17 designate side plates and 18, 19 respectively designate inlet and outlet joints.

Each of the inlet and outlet header pipes 1, 1 is longitudinally divided into the tank 2 and the end plate 3 both having outwardly an extending wall of substantially semi-circular cross-sections, respectively, so as to present together a substantially circular cross-section. Opposite joint side edges 3*a* of the end plate 3 are joined as by brazing to corresponding opposite joint side edges 2*a* of the tank 2 with said side edges 3*a* bearing against inner surfaces of said side edges 2*a*. To facilitate such joining, a curvature radius of the end plate 3 is dimensioned to be slightly smaller than that of the tank 2. A plurality of openings 5 for insertion of the respective flat tubes 14 are formed through said end plate 3 by pressing.

The feature of this embodiment that the end plate is shaped to have a convex cross-section and its opposite joint side edges are located against the inner surface of the tank is effective to enhance the strength of the end plate and to improve the pressure resistance of the header pipe to the coolant flowing therethrough. Furthermore, although the end plate is shaped to present the curved cross-section, formation of the tube insertion openings therethrough is easily done, since the header pipe is of two-component structure.

Now the second embodiment of the invention will be described in reference with FIG. 3.

Figure 3:
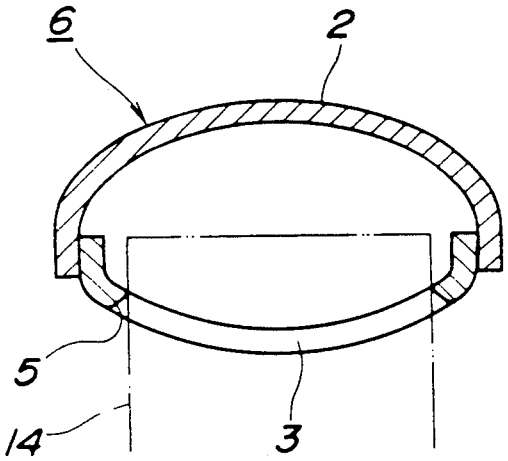
FIG. 3 is a cross-sectional view of the header pipe in a second embodiment of the invention.

According to the second embodiment illustrated by FIG. 3, the tank 2 and the end plate 3 are shaped and joined together so as to provide a header pipe 6 having an elliptical cross-section.

The tank and the end plate are shaped and joined together to provide a header pipe of substantially elliptical cross-section as has been mentioned above, so not only the same effect as has been mentioned with respect to the first embodiment is obtained but also the internal volume of the header pipe can be reduced and thereby the volume of coolant flowing therethrough can be also reduced.

Then, the third embodiment of the invention will be discussed with reference to FIG. 4.

Figure 4:
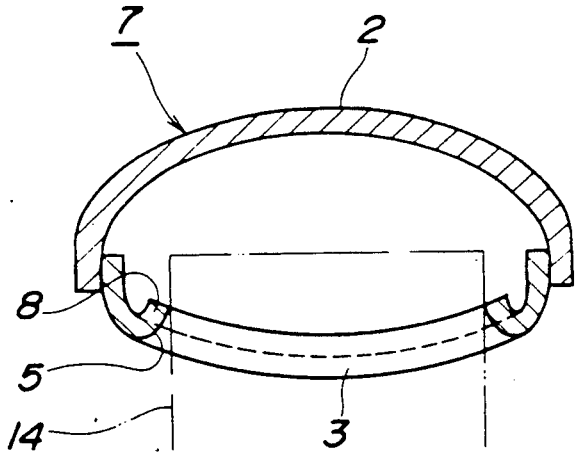
FIG. 4 is a cross-sectional view of the header pipe in a third embodiment of the invention.

In case of the third embodiment illustrated by FIG. 4, the tank 2 and the end plate 3 are shaped and joined together so as to provide a header pipe 7 being substantially elliptical in its cross-section and there are provided around the respective openings 5 formed through the wall of the end plate 3 for insertion of the respective flat tubes 14 projections extending into the interior of the header pipe 7, i.e., burrs 8. These burrs 8 are formed simultaneously when a plurality of insertion openings 5 are formed by pressing.

With this embodiment, it is possible to reduce the volume of coolant, and said burrs assure that the flat tubes can be reliably inserted into the insertion openings during installation of the flat tubes, improving the efficiency of installation.

The fourth embodiment of the invention will be explained in connection with FIG. 5.

Figure 5:
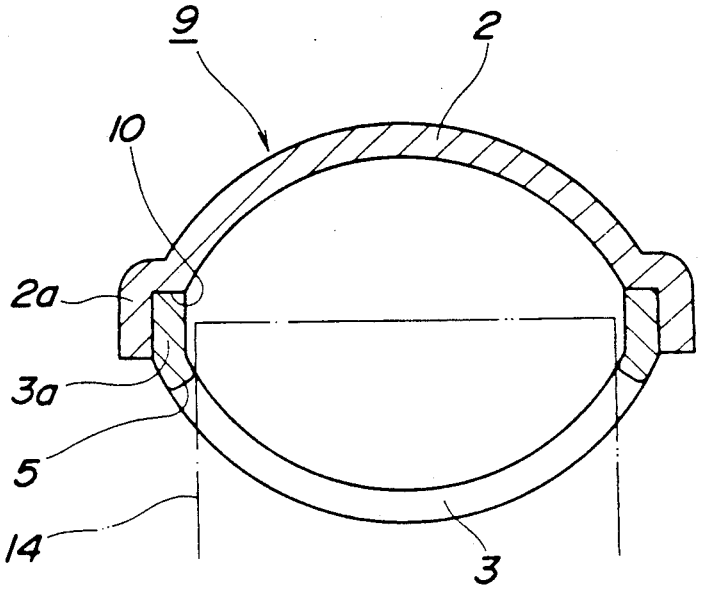
FIG. 5 is a cross-sectional view of the header pipe in a fourth embodiment of the invention.

In accordance with the fourth embodiment of FIG. 5, the tank 2 and the end plate 3 having a common radius of curvature are joined together to form a header pipe 9 being substantially elliptical in its cross-section. The opposite joint side edges 3*a* of the end plate 3 are joined to the corresponding joint side edges 2*a* of the tank 2 along the inner surfaces of said joint side edges 2*a*, wherein both the edges 2*a*, 3*a* are joined together along planar surfaces. More specifically, the joint side edges 2*a* of the tank 2 extend outwardly, then are bent toward the end plate 3 so as to form inner steps 10 against which the tips of the associated joint side edges 3*a* of the end plate 3 abut. The end plate 3 is jointed to the tank 2 in such relative position.

According to this embodiment, the joint side edges of the both components are joined together along the planar surfaces and the tank has the steps against which the tips of the joint side edges of the end plate abut as has been mentioned above, so it is possible, during operation of joining the end plate to the associated tank, to achieve a reliable positioning of the end plate circumferentially as well as in the joining direction and thereby to improve the efficiency of installation. Reliable positioning assures a uniform cross-section of the header pipe, which improves, in turn, convenience for installation of partition plates and covers.

Figure 6:
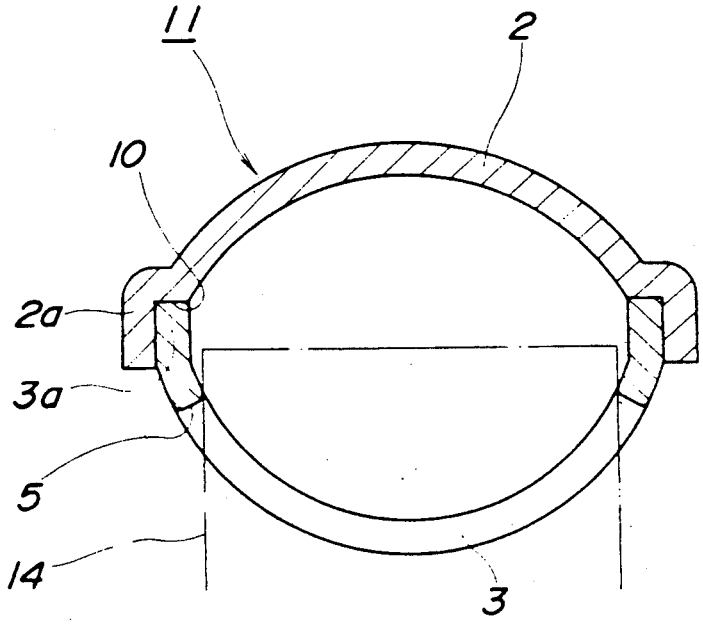
FIG. 6 is a cross-sectional view of the header pipe in a fifth embodiment of the invention.
Figure 7:
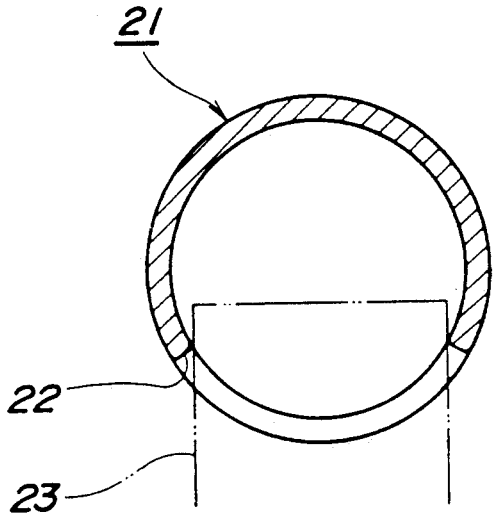
FIGS. 7 and 8 are cross-sectional views of the respective header pipes of the prior art.
Figure 8:
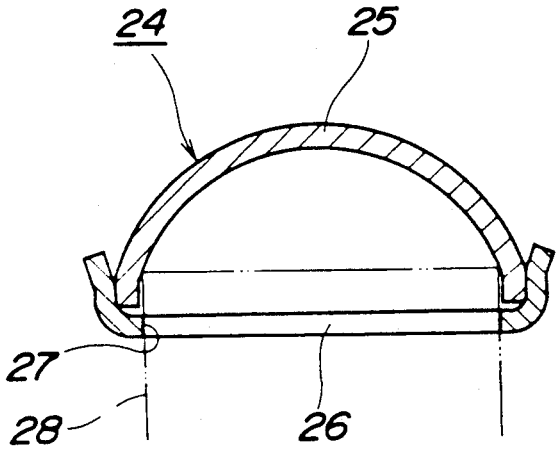

Finally, the fifth embodiment of the invention will be considered in reference with FIG. 6.

According to the fifth embodiment illustrated by FIG. 6, the tank 2 and the end plate 3 are respectively shaped so as to be convex in their cross-sections, said tank 2 being provided along the opposite joint side edges 2*a* with the inner steps 10, the curved wall of the end plate 3 being defined by a curvature radius smaller than that of the tank 2, and these two components are joined together to form a header pipe 11 having a substantially elliptical cross-section.

This embodiment provides, in addition to the effect achieved by the above-mentioned fourth embodiment, an advantage that the pressure resistance of the end plate can be further improved because the curvature radius thereof is smaller than that of the tank.

Although the respective embodiments have been described and illustrated on the assumption that the tank and the end plate have the same wall thickness, it is also possible to dimension the wall of the end plate thicker than that of the tank, for example, to dimension the former to 1.6 mm with respect to the latter of 1.3 mm, and thereby to enhance the pressure resistance of the end plate.

What is claimed is:

1. A condenser for use in an automobile comprising:

a pair of header pipes each consisting of a tank portion and an end plate;

a plurality of parallel flat tubes extending between said head pipes for supporting coolant flows, said header pipes having an oval cross-section, said end plates having a radius of curvature which is smaller than that of said tank portions, and said end plate being continuously outwardly curved and joined to said tank portion such that inside surfaces of opposite joint edges of said tank portion are overlapped on outside surfaces of opposite joint edges of said end plate, whereby said tank portion reinforces said end plate to withstand high pressure of said coolant flows.

2. The condenser of claim 1, wherein said joint edges of said tank portions have an L-shaped cross-section extending outwardly from a side edge thereof in parallel to a major axis of said oval cross-section and then downwardly in perpendicular to said major axis.

* * * * *